United States Patent [19]

Krings

[11] 3,950,952

[45] Apr. 20, 1976

[54] GUIDED HEAD FOR A TRENCH BRACE OF TRENCH SHEETING DEVICES

[76] Inventor: Josef Krings, Hans-Boeckler-Str. 23, D 5138 Heinsberg Oberbruch, Germany

[22] Filed: Nov. 22, 1974

[21] Appl. No.: 526,266

[30] Foreign Application Priority Data

Nov. 24, 1973 Germany ..... 2358621
Oct. 24, 1974 Germany ..... 2450505

[52] U.S. Cl. ..... 61/41 A; 49/409; 104/118; 104/244.1

[51] Int. Cl.[2] ..... E21D 7/00; E21D 15/50

[58] Field of Search ..... 61/41 A; 49/409; 160/201; 104/244.1, 245, 247, 118, 119

[56] References Cited

UNITED STATES PATENTS

| | | | |
|---|---|---|---|
| 615,176 | 11/1898 | Hillischer | 104/245 X |
| 3,425,162 | 2/1969 | Halpern | 49/409 X |
| 3,580,183 | 5/1971 | Nearman | 104/245 X |
| 3,621,660 | 11/1971 | Krings | 61/41 A |

*Primary Examiner*—Jacob Shapiro
*Attorney, Agent, or Firm*—Diller, Brown, Ramik & Wight

[57] ABSTRACT

This disclosure relates to a trench revetment device which includes a hollow post having a wall facing the interior of a trench and with the wall having a generally centrally disposed slot therein. A guiding head is carried by the post for receiving the end of one or more bracing studs and to position such braking stud or studs longitudinally of the post. The guiding head includes a head member disposed within the post and carrying sets of rollers facing in opposite directions and engaging opposite surfaces of the slotted wall. The head member also carries a support element for mounting a bracing stud with the support element extending through the slot.

16 Claims, 12 Drawing Figures

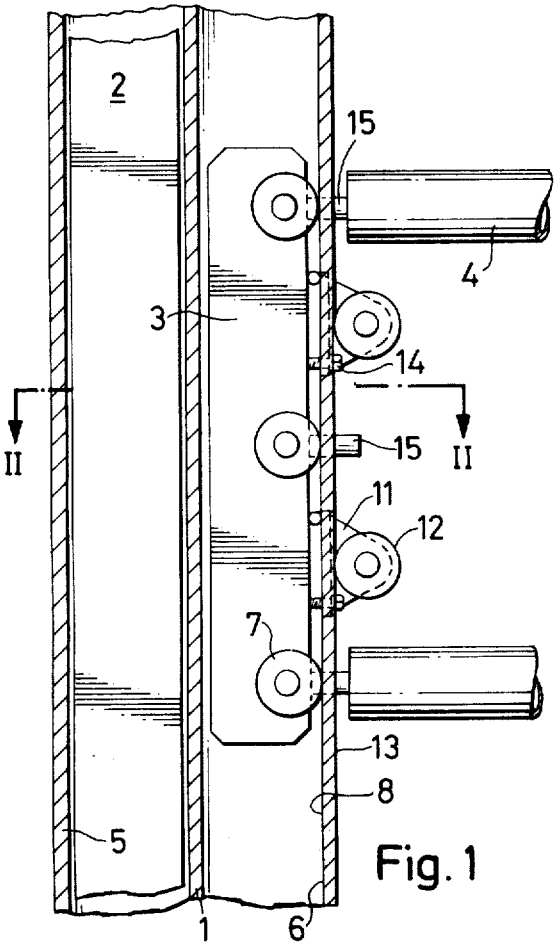
Fig. 1
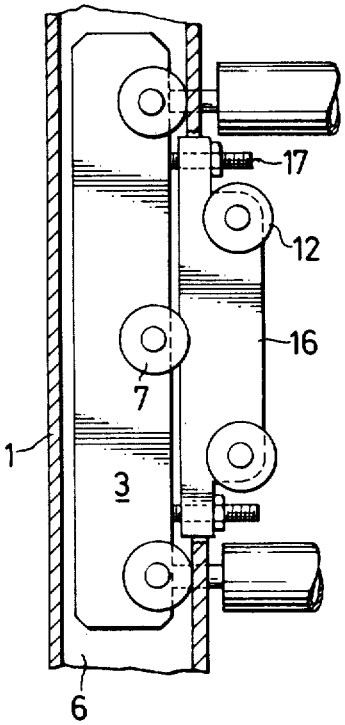
Fig. 3
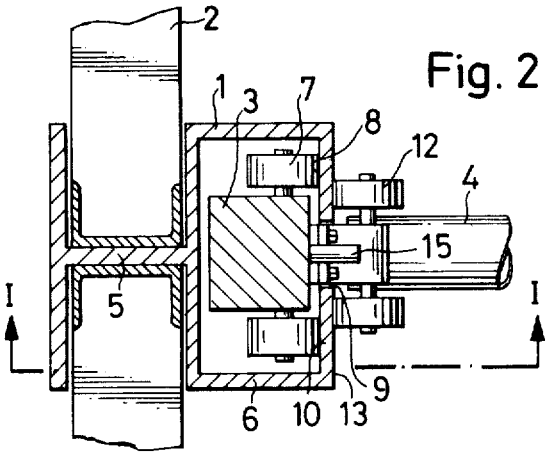
Fig. 2
Fig. 12
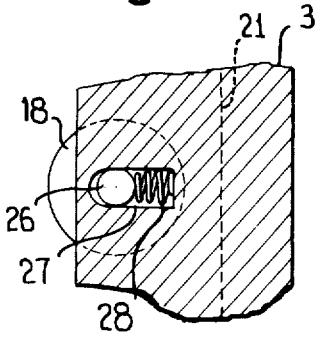

GUIDED HEAD FOR A TRENCH BRACE OF TRENCH SHEETING DEVICES

This invention relates in general to new and useful improvements in shoring devices and more particularly to a guiding head for bracing struts of ditch revetment devices having supported posts of a slotted box construction. There has been previously developed a revetment device in which superposed bracing struts are provided at their ends with dumb-bell type heads which are adjustable in vertical supporting posts of a box construction and wherein each post has a slotted wall facing the interior of the ditch. In such a device it is also suggested that the two superposed bracing struts be connected to each other. Such an arrangement is disclosed in German DT-AS 1,709,539.

It has been found that the guiding heads of the prior bracing strut arrangements tend to become twisted or distorted, especially when they are connected to each other in pairs. In addition to this, it has been found that there is required a relatively accurate guidance of the heads in the supporting posts which necessitates a special construction of the supporting posts. Even with this arrangement, extensive fitting and/or adjustment of the guiding heads with respect to the supporting posts is required. Further, the unhindered access of soil to the guiding posts leads to clogging of the guiding track and to jamming of the guiding heads.

This invention is based on the task of designing, in view of the deficiencies of the above-discussed prior art, a guiding head which eliminates the described disadvantages and makes possible easy and accurate movement of the guiding heads of the bracing struts.

A primary feature of this invention is the construction of a guiding head which includes a head member guided in the supporting posts and having at opposite sides thereof at least two pairs of rollers with the rollers of the pairs being longitudinally spaced and the rollers of each pair being transversely spaced, these rollers being inner rollers and running along the inner side of the slotted wall of the supporting posts, and there being further carried by the head member support brackets projecting through the slots with the support brackets carrying pairs of outer rollers running against the outer surface of the slotted wall, and the head member carrying at least one lug for connecting to an associated bracing strut.

The head member may also be braced relative to the supporting post by further rollers which engage either a wall or flange of the supporting post opposite to the slotted wall or on opposite sides of the slotted wall.

It is also preferable to provide means for adjusting the relative positions of the inner and outer rollers with a preferred adjusting means including the pivotal mounting of the support brackets at one end and the adjustable positioning of the other end of each support bracket by means of an adjusting screw.

A further characteristic of the invention is that the width of each support bracket is generally the same as that of the slot of the supporting post so as to make possible greater accuracy of guidance transversely of the post.

It is a further feature of the invention that the pairs of rollers moving along the inner and outer surfaces of the slotted wall are spaced longitudinally of the head member and are longitudinally offset from each other.

In order to prevent the slotted wall from becoming distorted due to the forces transmitted thereto, in accordance with a further form of the invention, at least one bracing roller is provided for running along that wall of the supporting post which is disposed opposite to the slotted wall with this bracing roller being carried by the head member.

At this time it is pointed out that it is preferable to have at least two of the bracing rollers carried on the head member in longitudinally spaced relation and the bracing rollers may be arranged in pairs projecting laterally from the head member and/or singly in recesses in that face of the head member remote from the slotted wall.

In order to prevent excessive stresses, it is preferable that the bracing rollers be elastically mounted for the movement in the direction of transmission of compressive forces acting on the bracing strut or to make the bracing rollers of an elastic material. It is also feasible to so elastically adjustably mount others of the rollers or to form them of an elastic material.

With the above and other objects in view that will hereinafter appear, the nature of the invention will be more clearly understood by reference to the following detailed description, the appended claims and the several views illustrated in the accompanying drawings:

In the drawings:

FIG. 1 is a fragmentary vertical sectional view of part of a revetment device in accordance with this invention taken along the line I—I of FIG. 2;

FIG. 2 is a fragmentary horizontal sectional view taken along line II-II of FIG. 1;

FIG. 3 is a fragmentary vertical sectional view similar to FIG. 1 of a modified form of guiding head.

FIG. 12 is a schematic view showing a resilient roller mounting.

Figure 4:
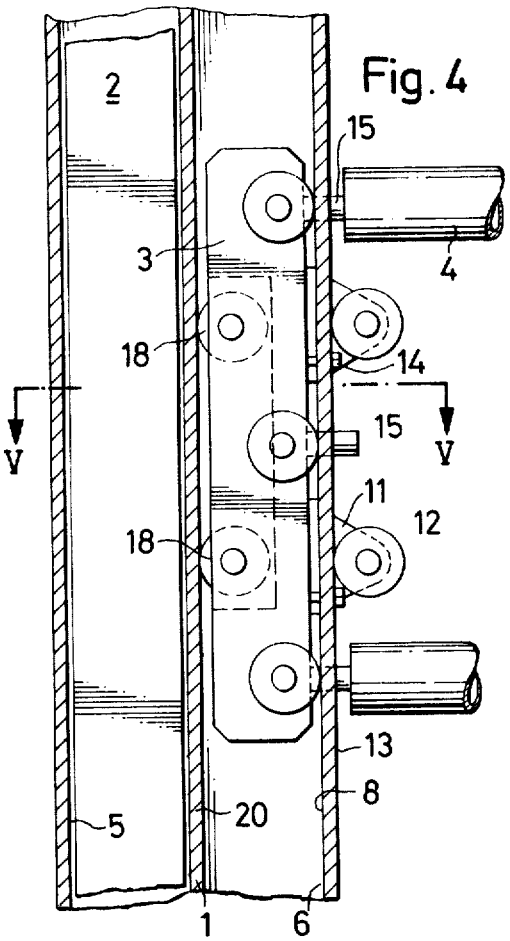
FIG. 4 is a fragmentary vertical sectional view of a part of a modified form of revetment device and is taken along line IV—IV of FIG. 5.

Referring now to the drawings in detail, it will be seen that there is illustrated a portion of a revetment device for trench revetments. With particular reference to FIGS. 1 and 2, it will be seen that the revetment device includes a supporting post 1 which is of a combination H and box cross-section so as to provide oppositely facing recesses opening transversely of the post for receiving end portions of revetment panels 2. In the box portion of the supporting post 1, there is positioned a guiding head which has a extending therefrom generally normal to the revetment panels 2 bracing struts 4.

It is to be understood that in the revetment construction, there will be a pair of the posts 1 arranged in a trench at opposite sides of the trench. The pairs of posts are located at the ends of the panels 2. Also, supporting posts may be arranged intermediate the ends of the panels 2. As previously described, each supporting post 1 is of a combina-H- and box shaped cross section, and more specifically includes and H-shaped holder 5 receiving the opposite ends of the revetment panels 2, and a slotted box portion 6 for receiving the guiding heads of the bracing struts 4, as is best shown in FIG. 2. It is to be understood that the H-shaped holder 5 may be omitted from the post 1 and a supporting post formed soley by the box shaped portion 6 may be utilized intermediate the ends of a panel 2.

The box shaped portion 6 of the supporting post 1 has mounted therein a head member 3 which has bilaterally distributed over its lengths a number of pairs of rollers 7 which will be considered inner rollers. The box shaped portion 6 includes an inner wall having a vertical slot therein defining a pair of flanges 10. The inner rollers 7 roll along the inner surface 8 of the flanges 10. The guiding head also includes several support brackets 11 which project through the slot 9 and carry outer pairs of rollers 12 which move along the outer surface 13 of the flanges 10. The support brackets 11 are so mounted so that the pairs of outer rollers 12 carried by them can be adjusted relative to the rollers 7. For this purpose, the support brackets 11 are supported relative to the head member 3 for pivoting about a transverse axis and at the opposite end are adjustably connected to the head member 3 by means of adjusting screws 14.

At this time it is pointed out that the pairs of inner rollers 7 and the pairs of outer rollers 12 are spaced longitudinally of the head member 3 and are longitudinally offset with respect to one another.

The head member 3 is further provided with laterally projecting lugs 15 to which can be releaseably attached the bracing struts 4 which are preferably longitudinally adjustable such as by way of counter-threaded components.

Figure 5:
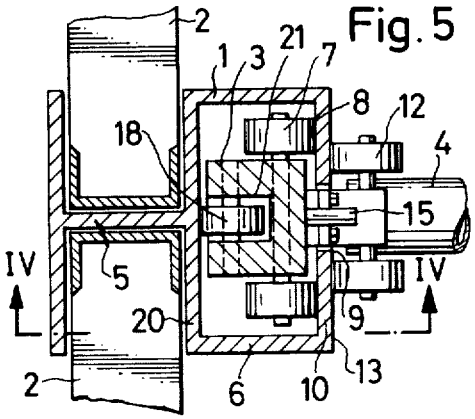
FIG. 5 is a fragmentary horizontal sectional view taken along line V—V of FIG. 4.

Referring now to FIGS. 4 and 5, it will be seen that the head member 3 is provided with a elongated recess 21 in the inner face thereof with the recess 21 facing an inner wall 20 of the supporting post opposite to the slotted wall 10. It is to be noted that the recess 21 is substantially in alignment with the center of the H-shaped holder 5, and there is mounted within the slot 21 at least one, and preferably 2, rollers 18. The rollers 18 function as bracing rollers and directly transmit loads from the struts 4 through the head member 3 to the inner wall 20 of the post 1.

Although the slot 21 has been illustrated as extending only a portion of the length of the head member 3, it is to be understood that the head member 3 could be of a channel construction and the slot 21 would then extend the full length thereof.

It is to be understood that the constructional details of the revetment device shown in FIGS. 4 and 5 are the same as those of FIG. 1 and 2 except for the addition of the bracing rollers 18.

Figure 6:
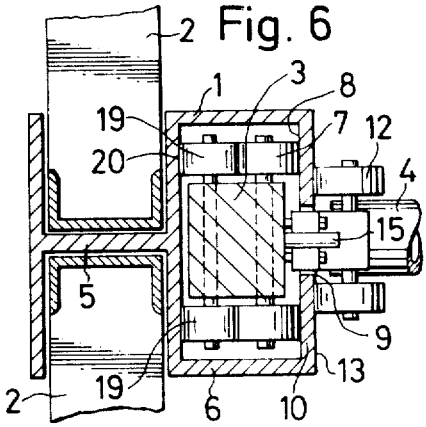
FIG. 6 is a fragmentary horizontal sectional view similar to FIG. 5 and shows another form of guiding head.

Referring now to FIG. 6, which illustrates a modification of the arrangement of FIGS. 4 and 5, it will be seen that the head member 3 may be provided with bracing rollers 19 arranged in pairs of opposite sides thereof. These bracing rollers also engage the wall 20 of the post 1 and directly apply a compressive force from the struts 4 through the head member 3 to the inner wall 20 of the post 1.

Figure 8:
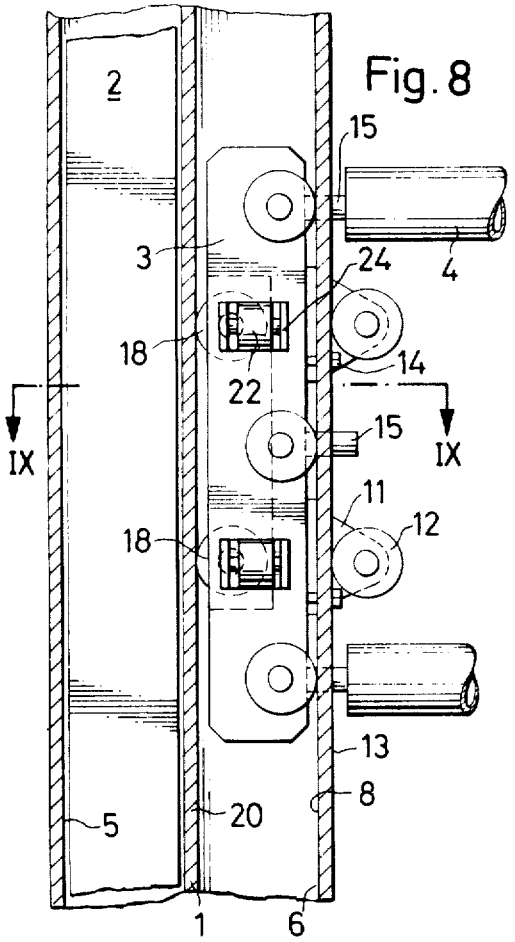
FIG. 8 is a fragmentary vertical sectional view similar to FIG. 1 taken along line VIII—VIII of FIG. 9 and shows another form of the invention.
Figure 9:
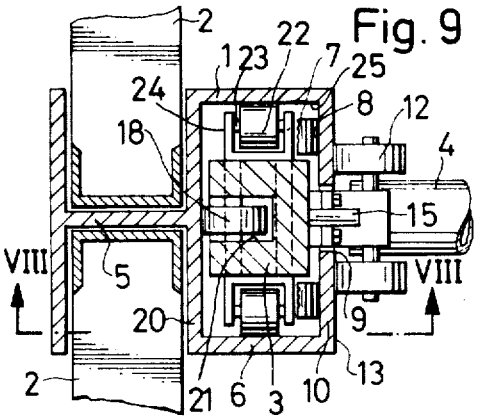
FIG. 9 is a fragmentary horizontal sectional view taken along line IX—IX of FIG. 8.

Referring is now made to FIGS. 8 and 9 wherein the revetment device of FIGS. 4 and 5 has been modified so as to include at least one pair of guide rollers 22 being mounted on the head member 3 and projecting from opposite sides thereof and engaging side walls 25 of the box shaped portion 6 of the post 1. Each guide roller 22 is mounted on a shaft 23 which, in turn, is carried by a bearing member 24 secured to a respective side of the head member 3.

Figure 10:
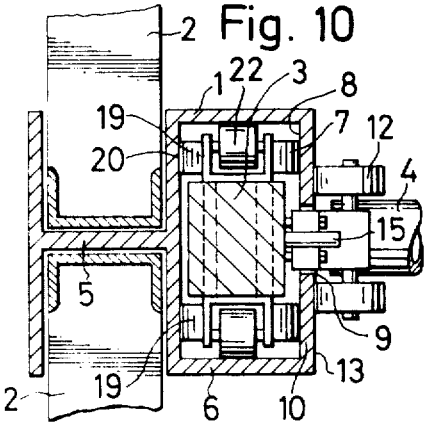
FIG. 10 is a fragmentary horizontal sectional view similar to FIG. 9 and shows a form of the invention similar to that of FIG. 6.

Referring now to FIG. 10, it will be seen that there is illustrated still a further form of revetment device wherein the head member 3 is provided with the guiding rollers 22, but the bracing rollers 18 have been eliminated. Essentially FIG. 10 illustrates a modification of the revetment device of FIGS. 1 and 2 with the addition of the guide rollers 22.

Figure 7:
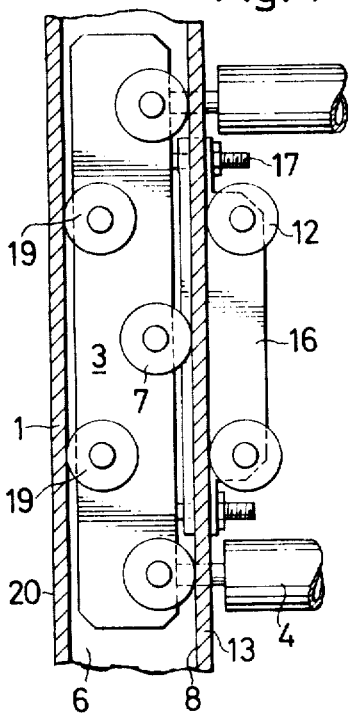
FIG. 7 is a fragmentary vertical sectional view similar to FIG. 4 and shows another form of guiding head.
Figure 11:
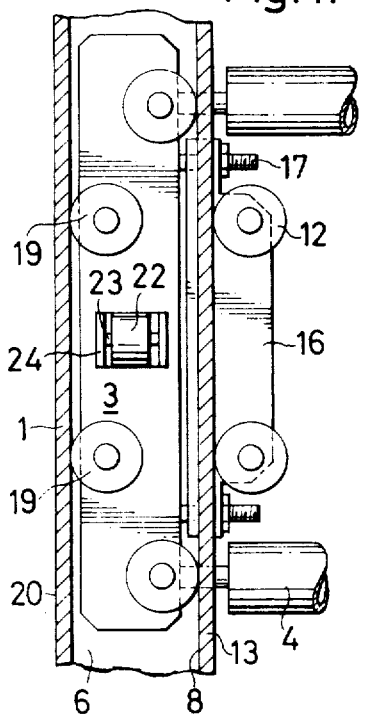
FIG. 11 is a fragmentary vertical sectional view similar to FIG. 8 and shows a form of the invention similar to that of FIG. 7.

Reference is now made to FIGS. 3, 7 and 11 wherein modifications of the revetment devices of FIGS. 1, 4 and 8, respectively, are illustrated. It is to be noted that in lieu of the individual support brackets 11 for each pair of further rollers 12, the pairs of further rollers 12 are carried by a single piece bar 16 which is mounted on a pair of threaded members 17 which are carried by the head member 3. Each threaded member 17 has associated therewith a nut and thus by adjusting the nuts carried by the threaded member 17, the bar 16 may be adjusted with respect to the head member 3 and thus adjust the spacing between the rollers 7 and 12.

In order to prevent excess stresses within the guiding head, the bracing rollers 18,19 and/or the guide rollers 7,12 and/or the guide rollers 22 can be formed wholly or partially of elastic material. On the other hand, these rollers can be supported in a flexible manner. A typical resilient mounting of the rollers is illustrated in FIG. 12 with respect to the bracing rollers 18 which are mounted on an axle 26 which is slidably mounted within a lateral slot 27 formed in the head member 3 on opposite sides of the slot 21. In each slot 27 there is a spring 28 engaging the axle 26 and urging the bracing roller 18 out of the head member 3. Other resilient mountings may be provided.

It is to be understood that the opposite ends of the bracing struts 4 are carried by guiding heads and that two of the bracing struts, together with two of the guiding heads, form a rigid frame which may be displaced vertically relative to a pair of opposing posts 1 without changing the geometry of the trench structure.

What is claimed as new:

1. A guiding head for a bracing strut of a trench revetment device of the type including a supporting post having a slotted wall with inner and outer surfaces, said guiding head comprising a head member, at least two pairs of inner rollers carried by said head member, said pairs of inner rollers being spaced longitudinally of said head member and inner rollers of each pair being transversely spaced, support bracket means carried by said head member for projection through a slotted wall, at least one pair of transversely spaced outer rollers carried by said support bracket means in spaced relation to said inner roller, the axes of rotation of said inner and outer rollers being in generally parallel relationship to each other, at least one support element means disposed generally in alignment with said support bracket means for attaching a bracing stud to said head member, and said support bracket means projecting beyond said inner rollers in a direction away from said at least one support element means whereby said support bracket means is adapted to be received within a slotted wall of a trench revetment device.

2. A guiding head according to claim 1 together with adjusting means for adjusting the spacing between inner rollers and said outer rollers.

3. A guiding head according to claim 2 wherein said adjusting means includes pivot means mounting said support bracket means on said head member for pivoting about a transverse axis, and adjustable connecting means between said support bracket means and said head member remote from said pivot means.

4. A guiding head according to claim 1 wherein said outer rollers are longitudinally offset relative to said inner rollers.

5. A guiding head according to claim 1 wherein said head member carries at least one further roller facing in a direction different from that of said inner rollers.

6. A guiding head according to claim 5 wherein there are a plurality of said further rollers and said further rollers are spaced from one another.

7. A guiding head according to claim 5 wherein there are a plurality of said further rollers and said further rollers are spaced from one another longitudinally of said head member.

8. A guiding head according to claim 5 wherein there are a plurality of said further rollers and said further rollers are spaced from one another transversely of said head member.

9. A guiding head according to claim 5 wherein said further roller extends in a direction opposite from that of said inner rollers.

10. A guiding head according to claim 5 wherein said further roller extends in a transverse direction.

11. A guiding head according to claim 5 wherein said head member has a recess therein, and said further roller is positioned in said recess.

12. A guiding head according to claim 5 wherein there are mounting means for said further roller resiliently urging said further roller away from the direction said inner rollers face.

13. A guiding head according to claim 5 wherein certain of said rollers are of a resilient construction.

14. A guiding head according to claim 5 in combination with a hollow post having a first wall disposed between said inner and outer rollers, a slot in said first wall between roller of each pair of inner rollers, and said support bracket means extends through said slot, and said post having a second wall engaged by said further roller for bracing said head member.

15. A guiding head according to claim 1 in combination with a hollow post having a first wall disposed between said inner and outer rollers, a slot in said first wall between roller of each pair of inner rollers, and said support bracket means extends through said slot.

16. A guiding head according to claim 15 wherein said support bracket means is of a width generally corresponding to the width of said slot.

* * * * *